United States Patent [19]

Chorneau

[11] Patent Number: 4,698,995

[45] Date of Patent: Oct. 13, 1987

[54] METHOD FOR STRETCH FORMING DROP HAMMER PARTS UTILIZING STRETCH WRAP FORMING TECHNIQUES

[76] Inventor: Frederick R. Chorneau, 2312 Grandview Ave., Manhattan Beach, Calif. 90266

[21] Appl. No.: 868,259

[22] Filed: May 28, 1986

[51] Int. Cl.[4] ..... B21D 11/02; B21D 25/02

[52] U.S. Cl. ..... 72/297; 72/302; 72/378

[58] Field of Search ..... 72/297, 296, 302, 378

[56] References Cited

U.S. PATENT DOCUMENTS

| | | | |
|---|---|---|---|
| 2,961,028 | 11/1960 | Bath | 62/297 |
| 3,034,560 | 5/1962 | Matthews | 72/297 |
| 3,113,607 | 12/1963 | Maize | 72/296 |
| 3,314,269 | 4/1967 | MacKenzie | 72/296 |

FOREIGN PATENT DOCUMENTS

| | | | |
|---|---|---|---|
| 710755 | 9/1941 | Fed. Rep. of Germany | 72/297 |
| 14031 | 2/1981 | Japan | 72/297 |

*Primary Examiner*—Daniel C. Crane
*Attorney, Agent, or Firm*—W. Thad Adams, III

[57] ABSTRACT

Jaws (20) and (23) on a stretch former (10) hold a metal sheet while the tension cylinders (18) and (19) stretch the metal sheet into its "yield state." In one embodiment, a bulldozer platen (33) carries a female die (32) into and out of forming contact with the metal sheet wrapped over a male die (31) carried between jaws (20) and (23). Bulldozer cylinders (35), (36), (38), and (39) are mounted in lightly spaced-apart relation to provide access to the metal forming parts of former (10). In another embodiment, a cantilever mounted transverse bulldozer beam (40) carries a female die (32). Beam (40) includes a retractable cylinder rod (46) which assists in moving die (32) into forming engagement with die (31) and, between reciprocations, can be retracted to permit unobstructed access to the metal forming interior of the machine.

2 Claims, 14 Drawing Figures

20
23
20A
23B
20B
23C
20C
23D
20D
23E
20E
170
171
172
173
147
150
151
152
146
145
148
149
142
140
143
139
141
144
29
28
157
158
154
156
155
153
121
106
P3T3

METHOD FOR STRETCH FORMING DROP HAMMER PARTS UTILIZING STRETCH WRAP FORMING TECHNIQUES

TECHNICAL FIELD AND BACKGROUND OF THE INVENTION

This application relates to a stretch forming apparatus, sometimes referred to as a stretch draw press, for forming drop hammer parts utilizing stretch wrap forming techniques. The apparatus and method described in this application combine in a novel manner techniques heretofore available only in distinctly separate machines and enables these functions to be carried out on a relatively low cost compact machine.

It is known that all metals and metal alloys become unusually ductile when stretched approximately 2 to 4%. In that state, referred to as a "yield state" or "yield range", such metals and metal alloys can not only be formed with about ⅓ the force normally required but also undergo a beneficial realignment of granular structure. Once the tension under which the forming takes place is released, completed parts exhibit increased tensile strength, freedom from internal stress and hightened shape retension. These phenomena are particularly useful in forming flat sheets of metal into complex shapes such as used in the aircraft and automobile manufacturing industry.

Prior art apparatus and techniques illustrative of the field in which this invention resides are illustrated in a publication of applicant entitled "Production Stretch-Draw Forming." Generally, stretch-draw forming can be broadly characterized as a method in which gripping jaws grasp opposite ends of a metal sheet and pull it to a minimum 2% stretch. After stretching, the sheet is pulled down over a bottom (male) die giving it a partial form. A top die mounted over the bottom die moves downwardly onto the stretched sheet completing the shape formation. Then, the gripper jaws move inwardly to release the tension on the sheet. The top die is raised away from the bottom die and the gripper jaws release the opposite sides of the metal sheet. Prior art devices of the type described are generally used in forming metal sheets having a relatively shallow formed shape. Other machines, such as radial draw forming machines, are used in forming deeper shapes, especially in elongated metal structures.

One problem heretofore encountered in stretch-draw forming large metal parts is the extent of vertical movement required to form a relatively deep formed shape in the metal sheet. Such machines are normally operated under semi-automatic as well as manual control and are always attended by at least one machine operator The metal sheet, both before and after forming, must be accessible to the machine operators so that the formed sheet can be removed and a new, unformed sheet placed in the machine. This problem is not encountered in stretch-draw formers which apply only a relatively shallow form to the sheet. However, as the depth of the form increases, the vertical distance over which the sheet must be drawn increases substantially. Depending on the construction of the machine, the sheet is either elevated out of easy reach of the operator or opposite ends of the sheet are positioned, in their formed state, substantially below floor level.

The stretch forming apparatus and method disclosed in this application also permit the formation of parts which heretofore could be formed only by use of a drop hammer. This also results in the saving of substantial machine weight and floor space.

The stretch forming apparatus and method disclosed in this application allows conventional stretch-wrap forming of work pieces, available heretofore only on horizontal stretch-wrap forming machines, known generically as "swing arm" machines, or on horizontal-type machines utilizing carriages and rail ways. The former has the disadvantages of requiring a large amount of floor space as well as being unsuited for combining stretch-wrapping with the secondary pressing action that achieves stretch-drawing since the drawing apparatus must necessarily be located in front of the machine, blocking access by the operators and rendering such a configuration impractical.

The latter, while allowing the stretch-wrapping to take place vertically and thus permitting an acceptable stretch-draw device to be employed, relies only on a rising die table to achieve stretch-wrap forming and thus the workpiece is necessarily raised well above floor level, over the operator's head, making it difficult to monitor and unload. The invention disclosed in this application relies on a new swinging arm concept to achieve wrapping in concert with a rising die table, mounting the machine in a vertical manner, thus permitting the stretch-drawing to take place vertically, above the machine out of the operator's way, and combining the two wrapping actions of arm swing and die table rise to keep the workpiece in a relatively centralized location, adding greatly to operator convenience.

SUMMARY OF THE INVENTION

Therefore, it is an object of the invention to provide a method and apparatus for stretch forming metal which could heretofore only be formed by a drop hammer.

It is another object of the invention to provide a stretch forming apparatus and method which is compact, less costly to construct and occupies relatively little floor space.

It is another object and advantage of the invention to provide a stretch forming method and apparatus in which the metal sheet being formed is readily accessible by machine operator both before and after the forming process.

These and other objects and advantages of the present invention are achieved in the apparatus according to the invention by providing an apparatus carriage on which is mounted in spaced-apart relation first and second arms which move independently in the vertical direction about a horizontally-disposed pivot axis. First and second tensioning means are carried by the first and second arms, respectively, for independent diverging movement relative to each other for tensioning a metal sheet into its yield range unidimensionally in the direction from one of its margins to its opposite margin.

First and second gripping jaws carried by and movable with the first and second tensioning means, respectively, receive and move into clamping engagement with the opposite margins of the metal sheet. A male draw-forming die is positioned intermediate the respective first and second arms, tensioning means and jaws. The metal sheet is wrapped thereon by the downward movement of the arms while maintaining the metal sheet in a tensioned state within its yield range. A complementary female down-acting die is mounted above the male die and moves downwardly into close proximity with the male die with sheet metal wrapped in a tensioned state therebetween. The metal sheet is formed into a predetermined shape whereupon the female die is moved upwardly out of proximity with the male die, the tension released and the sheet removed.

According to the embodiment of the invention disclosed in this application, the male die is positioned on a vertically movable die table which is moved upwardly as the arms are moved downwardly. Therefore, the depth of the form applied to the metal sheet results from the sum of the downward movement of the arms which causes the metal sheet to be wrapped onto the male die, and the upward movement of the vertically movable die table on which the male die is positioned. Accordingly, the metal sheet remains in a relatively central location where it can be reached and manipulated by the machine operator.

Preferably, the arms are pivoted on the carriage at a point below the level of the die table surface on which the male die is mounted, when the die table is at its lowermost position.

According to one embodiment of the invention disclosed in this application, side clamping means are provided for applying inwardly directed forming pressure to the metal sheet at substantially right angles to the direction of the tension applied by the tensioning means.

According to another embodiment of the invention disclosed in this application, the female down-acting die is mounted for reciprocating movement on a bulldozer platen, which platen includes a plurality of clamping cylinders mounted on the apparatus carriage in spaced-apart relation around its periphery. The cylinders are operatively connected with the bulldozer platen around the periphery of the platen in order to define sufficient space between the cylinders so that the metal sheet can be manually inserted therebetween into the jaws, and removed after stretch forming of the metal sheet has taken place.

According to another embodiment of the invention disclosed in this application, the female down-acting die is mounted on a cantilevered bulldozer beam positioned above the die table and which extends transversely from one side of the die table to the other side. Reciprocating means, preferably comprising first and second cylinders, operatively interconnect opposite sides of the bulldozer beam with the carriage.

Detaching means are provided for detaching and withdrawing one of the cylinders from the bulldozer beam to define an uninterrupted access space on one side of the beam so that the metal sheet can be manually inserted into and removed from the jaws from that side of the apparatus after stretch forming of the metal sheet has taken place and dies can be readily installed on and removed from the die table.

In accordance with the method disclosed in this application, stretch forming of a metal sheet takes place by tensioning and stretching a metal sheet to be formed into its yield range unidimensionally in a direction from one of its margins to its opposite margin. The opposite margins of the metal sheet are then moved downwardly to draw the sheet over a male draw-forming die positioned under the sheet, while maintaining the metal sheet in a tensioned state within its yield range. A complementary female down-acting die is mounted above the male die and reciprocates downwardly into close proximity with the male die while the metal sheet is wrapped in a tensioned state between the male and female die for imparting a predetermined shape to the metal sheet. Then the female die is moved upwardly out of proximity with the male die and the tension on the metal sheet is relieved. Preferably, the method includes the step of moving the male die vertically upwardly in the direction of the female die and in the direction opposite the downward movement of the margins of the metal sheet.

Also, the method includes the steps of mounting the female down-acting die on a bulldozer beam, and supporting the bulldozer beam on opposite sides thereof transverse to the tensioning direction of the metal sheet for reciprocating up and down movement in sheet forming cooperation with the male die. Between sheet forming operations, the support of the bulldozer beam on one side thereof is removed and the beam is supported only on the other side while the formed sheet is removed from the one side and an unformed sheet is placed in the jaws from the same one side.

BRIEF DESCRIPTION OF THE DRAWINGS

Some of the objects of the invention have been described above. Other objects and advantages of the invention will be explained below as the description of the invention proceeds in connection with the following drawings, in which.

DESCRIPTION OF THE PREFERRED EMBODIMENT

Figure 1:
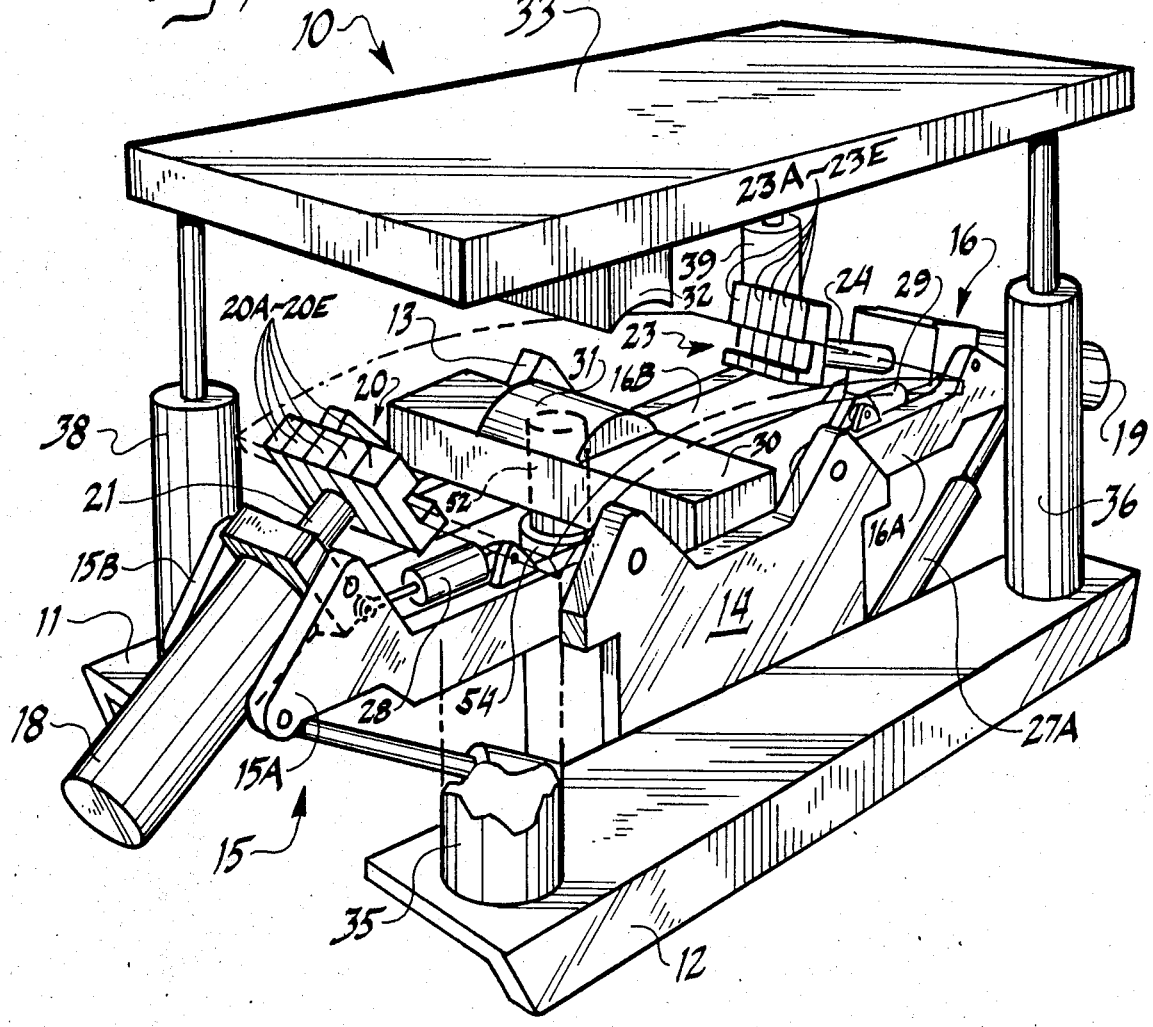
FIG. 1 is a perspective view, with parts broken away of a stretch former according to one embodiment of the invention.

Referring now specifically to the drawings, a stretch forming apparatus according to one embodiment of the invention is shown in FIG. 1 and designated broadly at reference numeral 10. Stretch former 10 comprises a carriage which includes a pair of longitudinally extending supports 11 and 12 between which are mounted, respectively, spaced-apart center sections 13 and 14. Typically, supports 11 and 12 are positioned at about floor level and straddle a pit (not shown) into which parts of stretch former 10 may extend during certain steps in the stretch forming process.

A left-hand arm 15 and a right-hand arm 16 are pivotally mounted on opposite ends of and between center sections 13 and 14. Left-hand arm 15 and right-hand arm 16 are formed of two spaced-apart arm members 15A, 15B and 16A, 16B, respectively, on which are mounted, respectively, a left-hand tension cylinder 18 and a right-hand tension cylinder 19. A left-hand power segmented jaw 20 is mounted on the free end of a cylinder rod 21 controlled by left-hand tension cylinder 18. Similarly, a right-hand, power segmented jaw 23 is mounted on the free end of cylinder rod 24 controlled by right-hand tension cylinder 19.

Jaws 20 and 23 are mounted transversely to a die mounting surface to be described below, and have five segments 20A–20E and 23A–23E, respectively, which are power curvable to permit them to attain both convex and concave shapes while holding a metal sheet (shown in phantom lines in FIGS. 1 and 2) in a tensioned state within its yield range. The jaws 20 and 23 each exert a pressure of about 200 tons on the sheet being held and maintain a constant pull on the sheet during the forming cycle.

Left-hand tension cylinder 18 and right-hand tension cylinder 19 and arms 15 and 16, respectively, are controlled by left-hand arm actuating cylinder 26A and 26B, and right-hand arm actuating cylinders 27A and 27B.

A left-hand swing cylinder 28 and a right-hand swing cylinder 29, shown in FIG. 1, counterbalance jaws 20 and 23, respectively, to maintain the jaws at any selected position.

A die table 30 is mounted between center sections 13 and 14 and between left-hand jaw 20 and right-hand jaw 23. A male die 31 is positioned on the top surface of die table 30 and mates with a female down-acting die 32 which is mounted for reciprocating up and down motion on a bulldozer platen 33.

Bulldozer platen 33 is moved up and down by two front bulldozer clamp cylinders 35 and 36 mounted on support 12 and two rear bulldozer clamp cylinders 38 and 39 mounted on support 11. Simultaneous actuation of cylinders 35, 36, 38 and 39 move bulldozer platen 33 downwardly, bringing female die 32 into forming contact with the sheet wrapped over male die 31. Reverse movement of cylinders 35, 36, 38 and 39 moves bulldozer platen 33 and die 32 upwardly away from die 31.

Cylinders 35, 36, 38 and 39 are positioned at extreme corners of stretch former 10 in order to provide easy access to the interior of stretch former 10 by its operating personnel. Blank metal sheets can easily be positioned in jaws 20 and 23 by inserting the sheet between cylinders 35 and 36 or cylinders 38 and 39. Likewise, the metal sheet can be removed after forming in the same manner.

Figure 2:
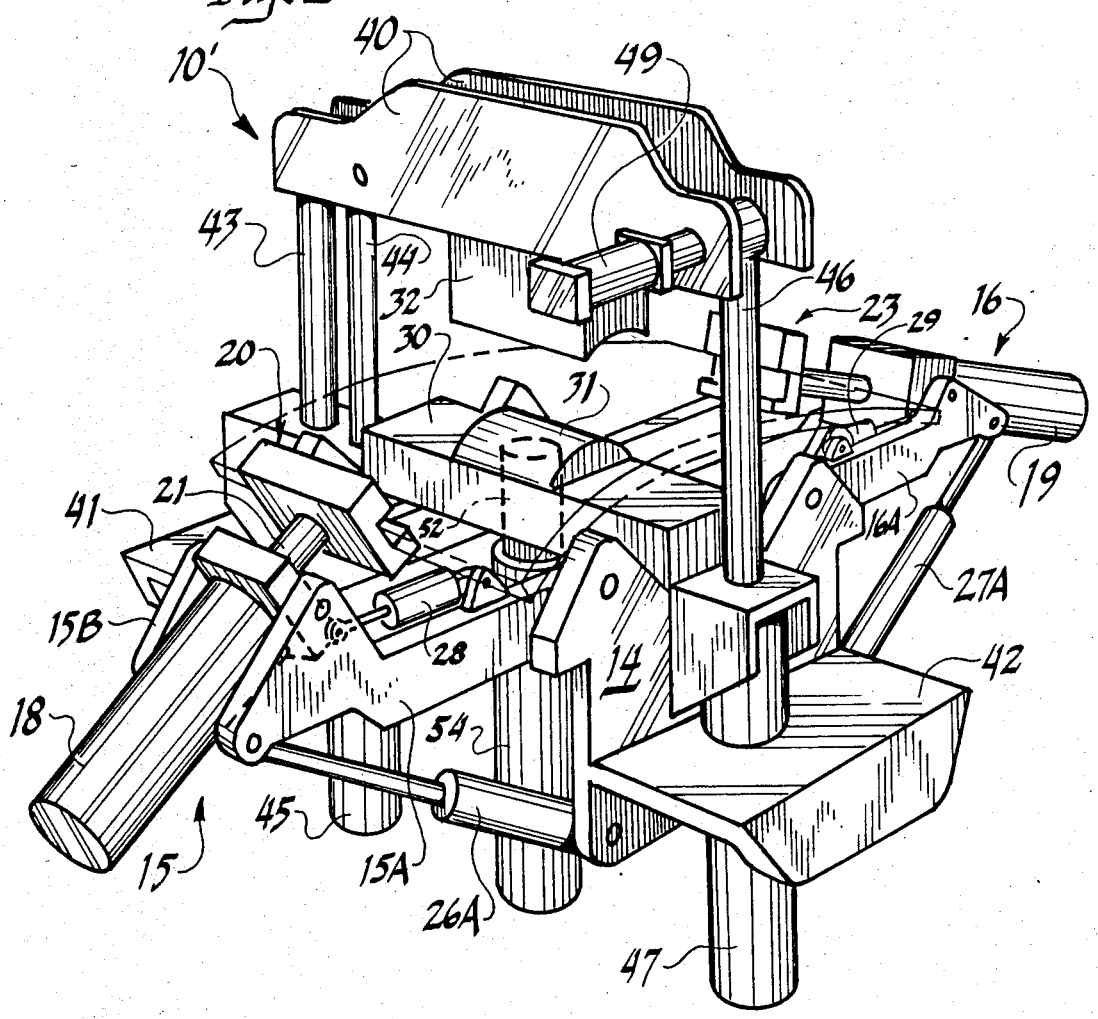
FIG. 2 is a perspective view of another embodiment of the invention.

Another embodiment of the stretch former according to the present invention is illustrated in FIG. 2 and indicated broadly at reference numeral 10'. Many of the parts of the formers 10 and 10' shown in FIGS. 1 and 2 are identical and are therefore identically referenced. The primary difference between the embodiments shown in FIGS. 1 and 2 reside in the manner in which the down-acting die 32 is moved down into and raised out of forming contact with die 31.

In FIG. 2, a bulldozer beam 40 is cantilever mounted transversely from one side of die table 30 to the other above supports 41 and 42. Supports 41 and 42 are at about floor level. Bulldozer beam 40 is supported on one side by a bulldozer guide rod 43 and a permanently attached cylinder rod 44 of a bulldozer clamp cylinder 45. The other side of bulldozer beam 40 is detachably supported by a cylinder rod 46 of a bulldozer clamp cylinder 47. A bulldozer retractable lock cylinder 49 is on beam 40 mounted perpendicularly to cylinder rod 46 and locks beam 40 to cylinder rod 46 during reciprocating up and down movement.

Figure 3:
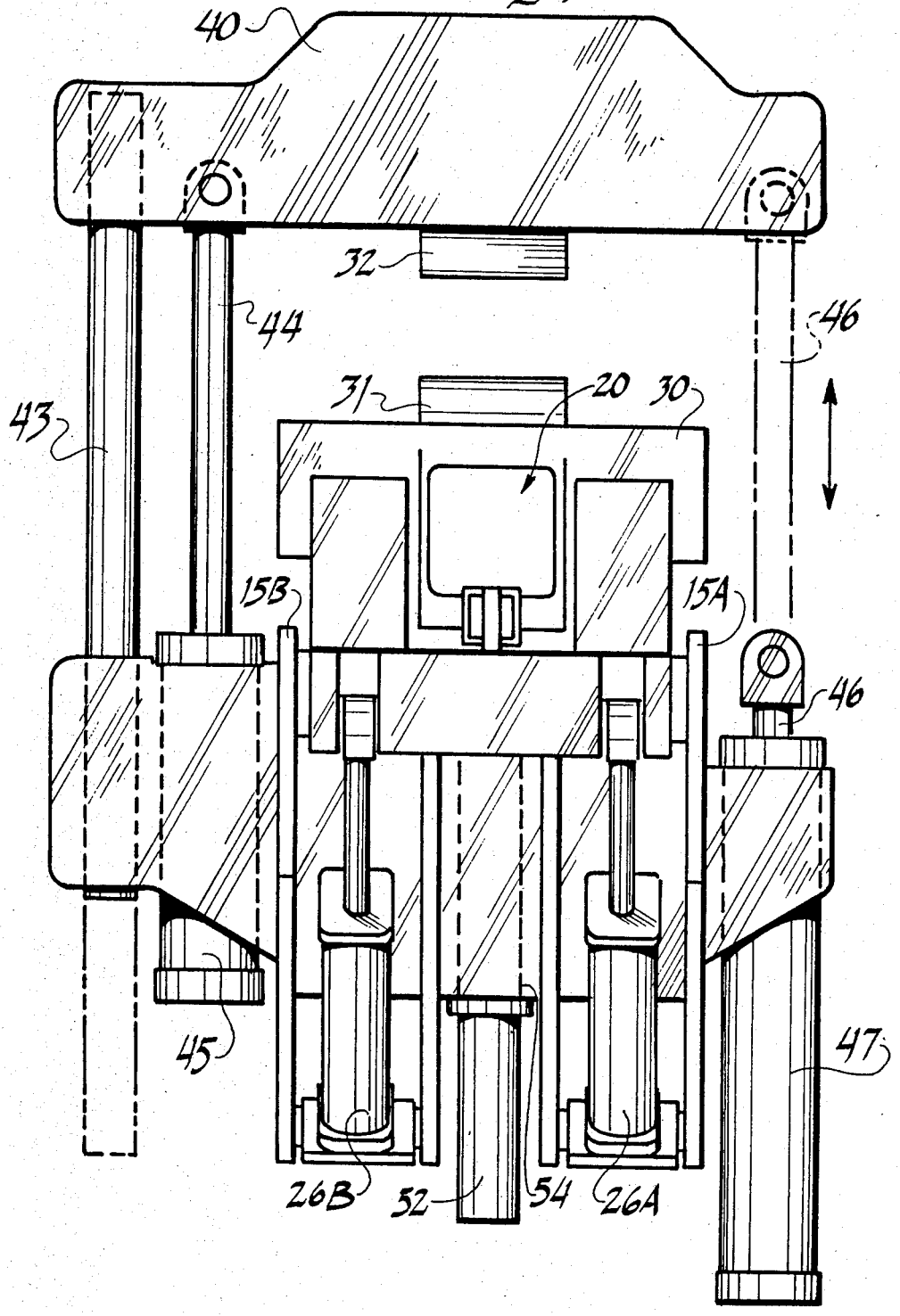
FIG. 3 is an end view of the embodiment of the stretch forming apparatus shown in FIG. 2.

As is best shown in FIG. 3, cylinder rod 46 is released from beam 40 and is retracted into cylinder 47 between forming cycles. This leaves one side (left side as shown in FIG. 3) of stretch former 10' completely open so that the machine operator can easily insert and remove metal sheets. For the next reciprocation, cylinder rod 46 is reextended upwardly and bulldozer lock cylinder 49 detachably secures cylinder rod 46 to bulldozer 40 once again.

Figure 4:
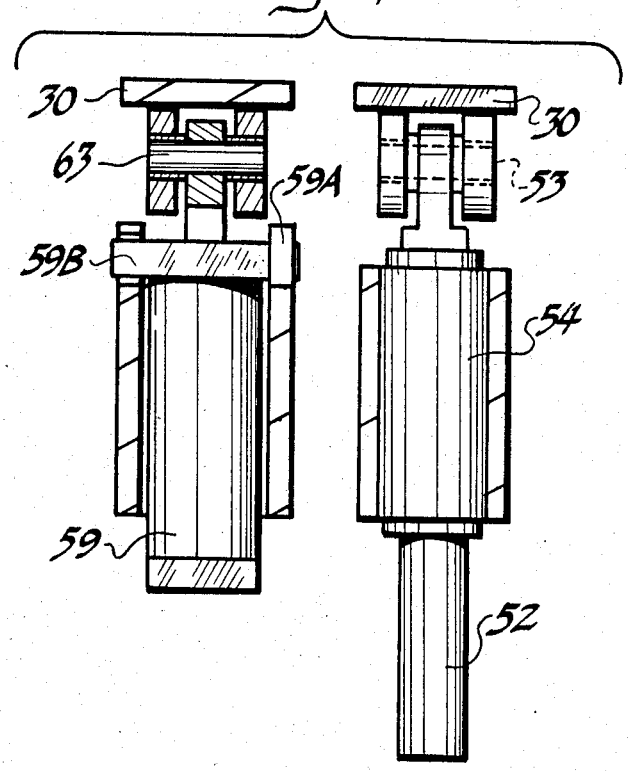
FIG. 4 is a side elevational view of the die table cylinder assembly (left) and one of the die table guide rods (right)
Figure 9:
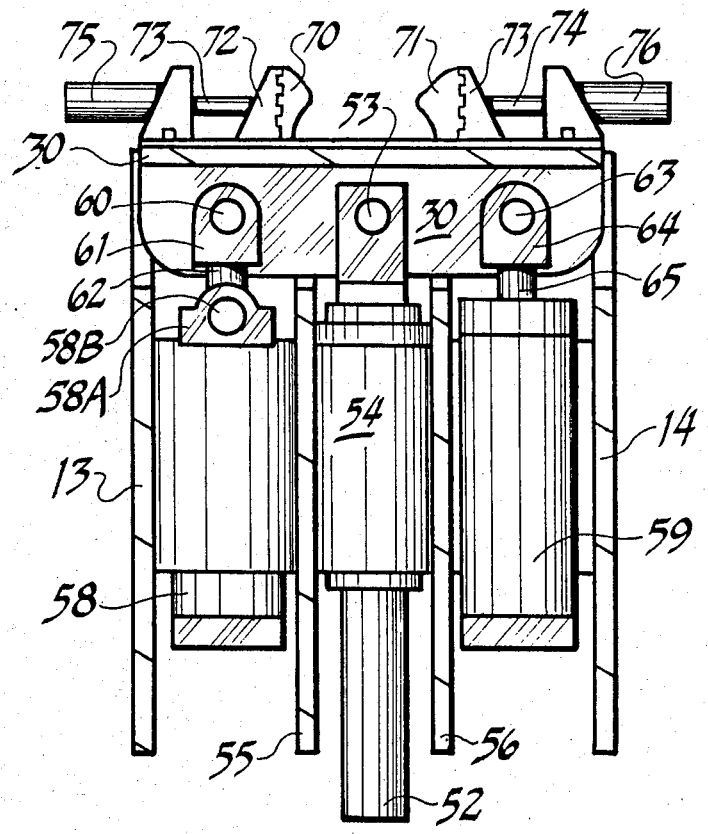
FIG. 9 shows the die table assembly with side clamps thereon.
Figure 10:
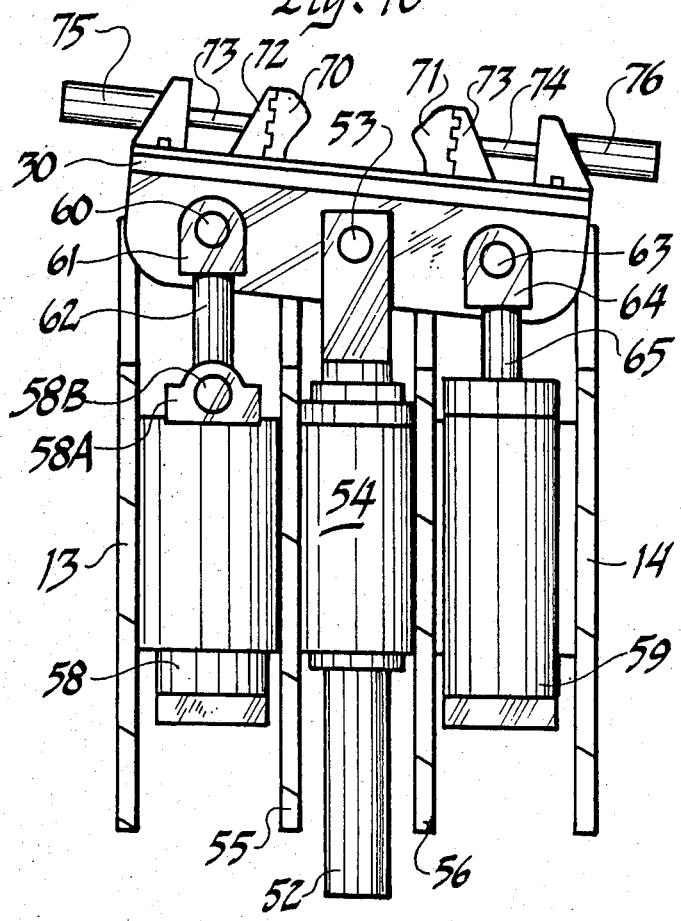
FIG. 10 illustrates the ability of the die table to tilt side-to-side.

The operation of die table 30 will bow be explained in more detail with particular reference to Figures 4, 9 and 10. Referring first to FIG. 9, die table 30 is mounted between center sections 13 and 14 on a guide rod 52. Guide rod 52 is pivotally attached to die table 30 by means of a pin 53 and is positioned in a guide rod sleeve 54 which is secured to two spaced-apart structural members 55 and 56. Up and down motion of die table 30 is provided by two transversely-mounted die table cylinders 58 and 59. Die table cylinder 58 is connected to die table 30 by a pin 60 through a rod end 61 of cylinder rod 62 and supported on a bearing block 58A by a pin 58B.

Likewise, die table cylinder 59 is pinned to the other side of die table 30 by a pin 63 through a rod end 64 of die table cylinder rod 65. Die table 30 will pivot freely on pins 50, 60 and 63 to the extent permitted by the relative motion of die table cylinders 58 and 59.

In FIG. 4, guide rod 52 and die table cylinder 59 are shown in a side view. Note in FIG. 4 that die table cylinder 59 is mounted on a bearing block 59A.

As is shown in FIG. 10, cylinders 58 and 59 can be independently actuated to cause die table 30 to tilt end-to-end. This is particularly desirable when the die 31 has an asymmetrical top profile. In order to make the stretch imparted to the metal sheet as uniform as possible across its entire surface area, the top profile of die 31 should be as close to horizontal as possible. By independent control of die table cylinders 58 and 59, this is easily accomplished.

Figure 11:
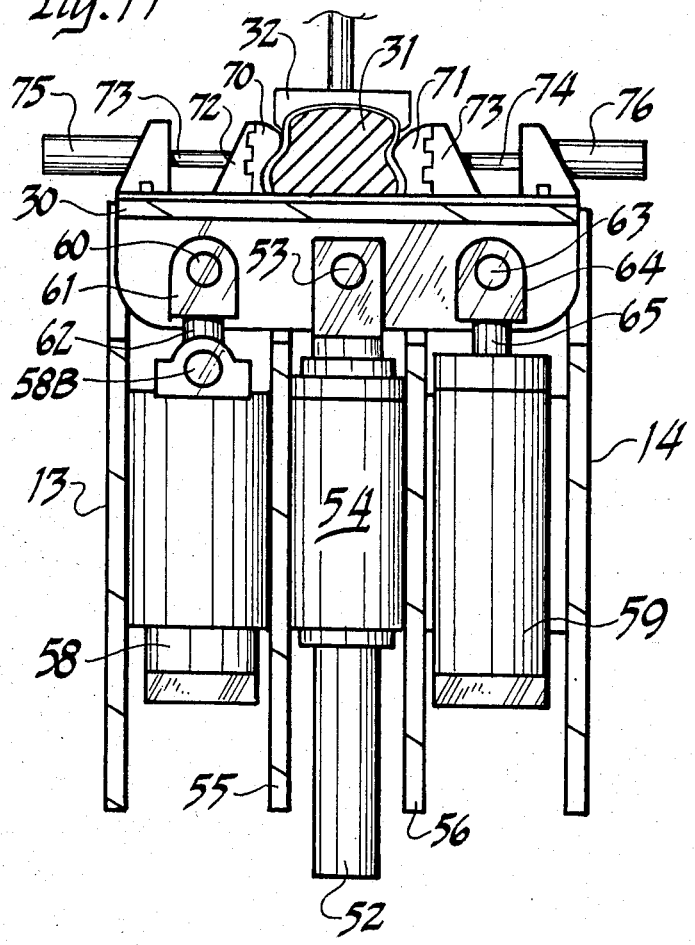
FIG. 11 illustrates cooperation of the side clamp dies with the male and female dies.

An optional feature includes the provision of side clamping dies 70 and 71 (FIGS. 9 and 10). Side clamp dies 70 and 71 are mounted on the end of clamps 72 and 73, respectively, and are carried on the end of cylinder rods 73 and 74 of side clamping cylinders 75 and 76. These components are designed for quick placement on and removal from die table 30 as desired. Side clamping dies 70 and 71 are necessary when forming certain parts which require forming in several dimensions at once. An example of this is shown in FIG. 11, where side clamping dies 70 and 71 move inwardly against the sides of die 31 at right angles to the direction of tension on the metal sheet.

Figure 5:
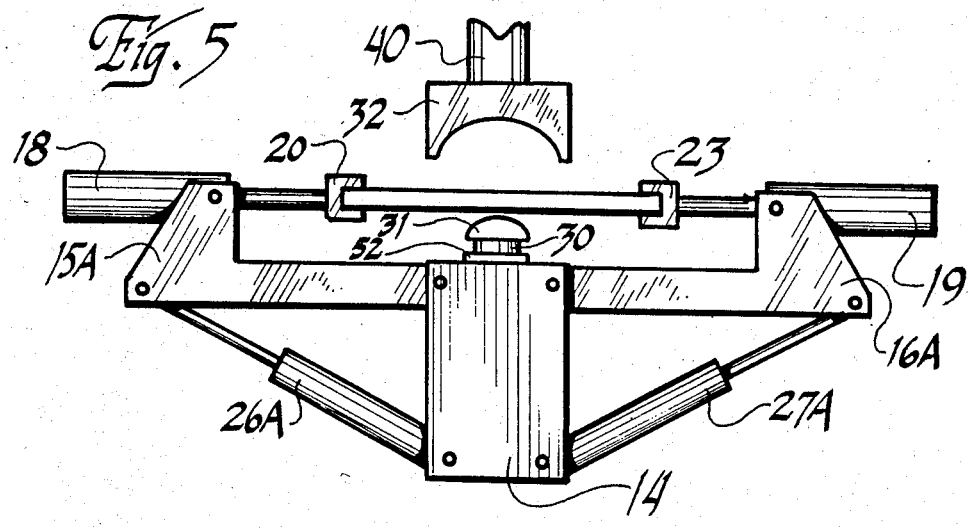
FIGS. 5, 6, 7 and 8 illustrate in further simplified form the steps of the process according to the present invention.

Referring now to FIG. 5, in operation arms 15 and 16 are elevated to allow level loading of the metal sheet over die table 30 and die 31. Jaws 20 and 23 are straight, open and outboard far enough to accept the length of the metal sheet. Die 32 is in its retracted position. Die table 30 is tilted as described above to make as nearly horizontal as possible the profile of die 31, if the profile is not symmetrical. This enables the stretching of the metal sheet to be equalized to the maximum degree possible. When the metal sheet is properly positioned in jaws 20 and 23, they are activated and the gripping force is applied to the metal sheet.

Figure 6:
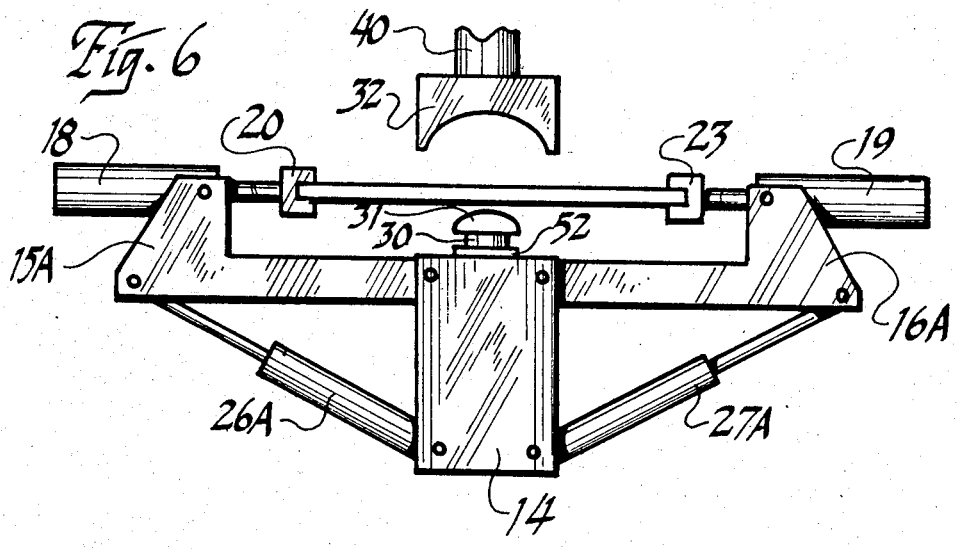

As is shown in FIG. 6, with the workpiece loaded and both jaws 20 and 23 closed, jaws 20 and 23 are moved away from each other by actuation of tension cylinders 18 and 19 until the yield range of the metal sheet is achieved.

Then, jaws 20 and 23 are caused to curve to approximate the profile of die 31. Die table 30 is then activated, causing it to rise under the metal sheet. At the same time, arms 15 and 16 are rotated downwardly. Swing cylinders 28 and 29 are in a "float" mode so that as die table 30 rises and arms 15 and 16 rotate, the pull of the jaws 20 and 23 is always along a line tangent to die 31 on opposite sides. This prevents the metal sheet from kinking or bending.

Figure 7:
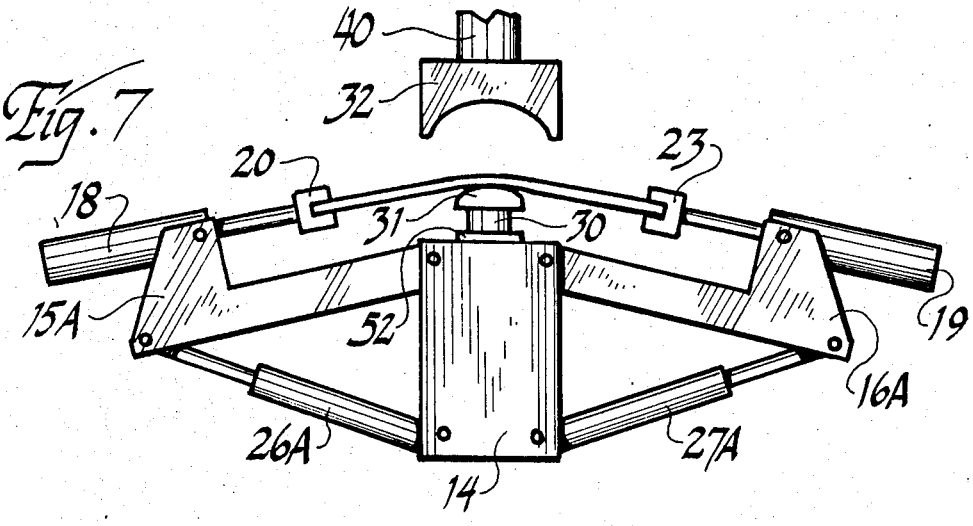

While arms 15 and 16 and die table 30 are moving in order to wrap the sheet, the tension cylinders maintain the stretch in the workpiece at a constant level so that the yield range is not exceeded. If desired, the tension cylinders can be programmed to vary the stretch during portions of the cycle but this not necessarily a likely occurrence except when forming certain parts. (See FIG. 7).

Figure 8:
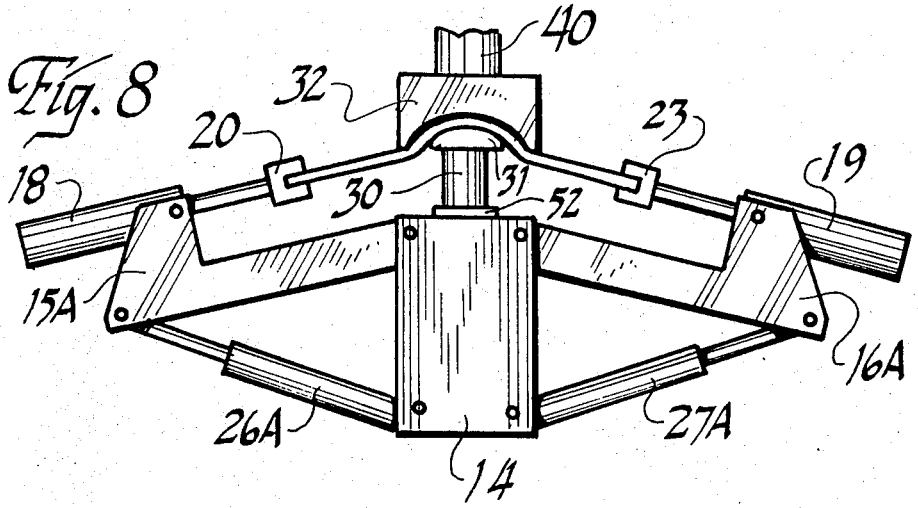

Die table 30 continues to rise and arms 15 and 16 continue to rotate until the sheet has been wrapped onto die 31 to the degree desired. At the appropriate position, die table 30 ceases its upward movement and arms 15 and 16 cease rotation. At the same time, die 32 is reciprocated downwardly into contact with the sheet. (See FIG. 8). This step can be carried out at any time during the wrap cycle or delayed until the part is completely wrapped over die 31, depending upon the particular technique employed. The downward force of die 32 is limited to somewhat less than ½ of the upward thrust of die table 30. This allows die 31 to overcome the opposite force of die 32 while clamping the sheet.

Since the side clamp cylinders 75, 76 and dies 70, 71 are mounted on die table 30, they may be actuated at will.

Once the sheet is completely formed, tension on the sheet is relaxed by moving the jaws 20 and 23 slightly towards each other. Then, the jaws can be opened and the dies 31 and 32 separated, together with the side clamp dies 70 and 71, if used. In the stretch former 10' shown in FIG. 2, the cylinder rod 46 is then retracted downwardly leaving the beam 40 in a cantilevered position with an opening sufficient for the formed sheet to be easily removed by the machine operator. Then, a new sheet is loaded as described above and the entire process is repeated. Arms 15 and 16 are independently actuated and controlled so that sheets may be bent in an unsymmetrical fashion where one side does not need to be wrapped as far over die 31 as the other side.

As is apparent from the foregoing, the metal sheet is formed by a combination of the upward movement of die table 30 and the simultaneous downward movement of jaws 20 and 23. Therefore, the sheet is maintained in a relatively central position where it can be easily reached and manipulated by the machine operator.

Figure 12:
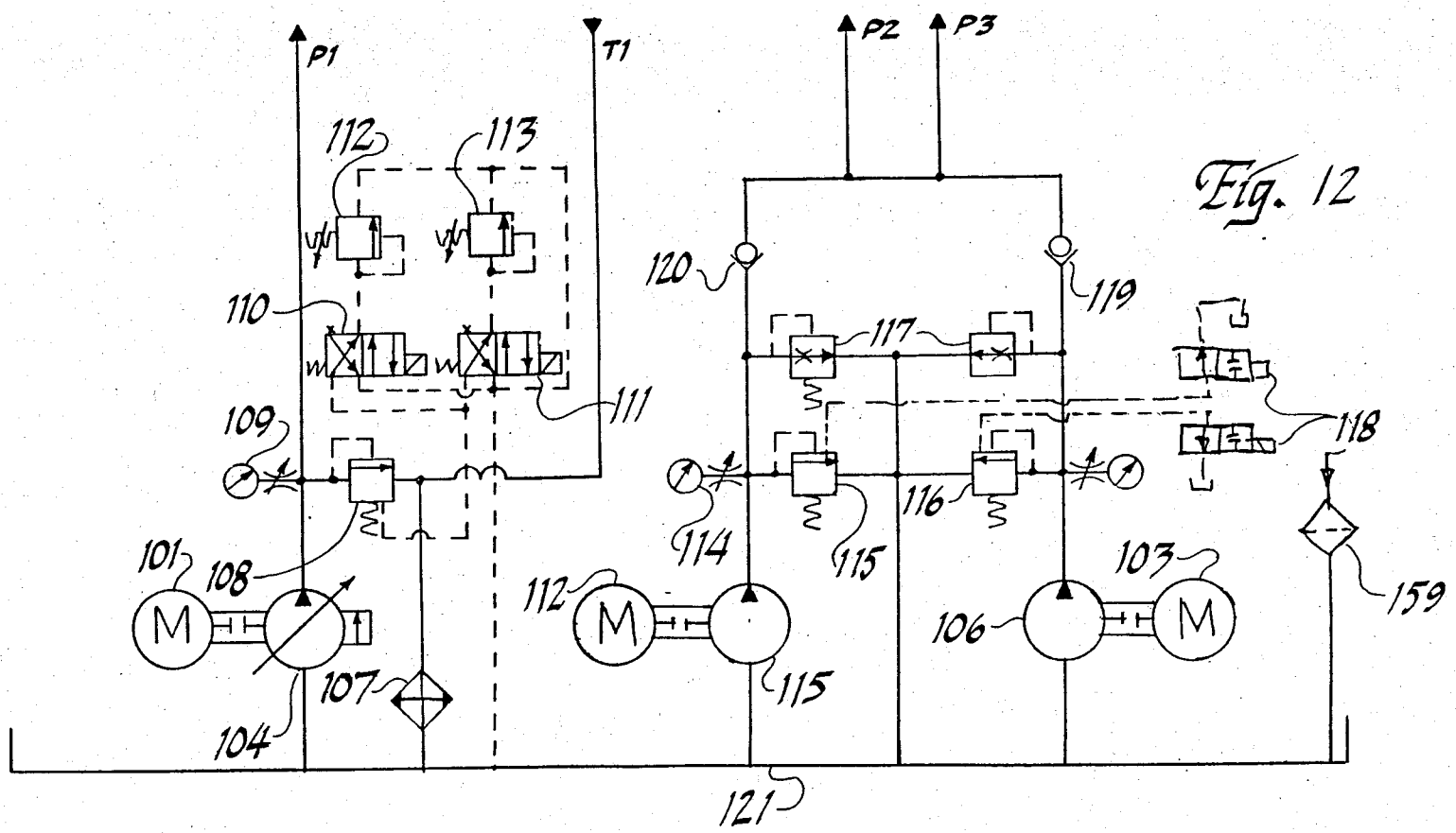
FIGS. 12, 13 and 14 illustrate schematically the operation of the hydraulic system of the embodiment of the invention shown in FIG. 2 and following drawings.

Referring now to FIG. 12, the hydraulic system will be explained. An electric motor 101 drives a tension cylinder pump 104. Tension cylinder pump 104 is a variable volume, pressure compensated pump which supplies oil to the tension cylinder circuit exclusively.

An electric motor 102 drives a fixed volume pump 105 which supplies hydraulic fluid to die table 30, bulldozer platen 33 or bulldozer beam 40, and arm actuating cylinders 26 and 27.

An electric motor 103 drives a fixed volume pump 106 which supplies hydraulic fluid to jaws 20 and 23, and swing cylinders 28 and 29. A water/oil heat exchanger 107 maintains the temperature of the hydraulic fluid in the tension cylinder circuit within limits. A relief valve 108 limits maximum pressure in the tension cylinder circuit to approximately 3000 pounds per square inch. A pressure gauge and snubber 109 enables the pressure in the tension cylinder circuit to be monitored and controlled.

Solonoid operated selector valves 110 and 111 are used during a manual pressure forming mode to change the pressure in the tension cylinder circuit to achieve an unload pressure, a wrapping or forming pressure, and a high or "setting" pressure which is sometimes used to set a part above the yield point after the wrapping process is complete. A pilot relief valve 112, which is set by solonoid selector valve 110, drops the main relief pressure at relief valve 108 to the wrap pressure as dictated by the setting on the pilot relief valve 112. A pilot relief valve 113, whose setting is selected by operation of solonoid selector valves 110 and 111, drops the main relief pressure to the lowest pressure which will still move tension cylinders 18 and 19. This pressure is required to unload the formed sheet. This pressure is usually selected automatically at the end of a cycle.

A pressure gauge and snubber 14 permits the pressure to be monitored and adjusted within the circuits which control die table 30, bulldozer platen 33 or bulldozer beam 40, and arm actuating cylinders 26 and 27.

The flow from fixed volume pumps 105 and 106 are tied together at a connection intermediate valves 115 and 116. The two pumps 105 and 106 are used instead of one pump to keep pressure at an acceptable level during all phases of operation. However, in certain circumstances and under certain conditions, a single pump would suffice to operate the die table, bulldozer and arm actuating circuits together with the jaw and swing cylinder circuits. The pressure relief valves 115 and 116 protect their respective pumps 105 and 106, and are typically set at the maximum circuit pressure of about 3000 psi.

A pair of air bleed valves 117 exhaust any air from pumps 105 and 106 at start-up.

A pair of solonoid operated selector valves 118 drop the pressure in relief valves 115 and 116, respectively, to the unloading pressure. Therefore, pumps 105 and 106 can be started in an unloaded condition and can remain unloaded unless demand is made for fluid pressure in the controlled circuit. Line check valves 119 and 120 are used when the pumps 105 and 106 are tied together so that one of the pumps 105 or 106 can be unloaded and the circuit downstream of the check valve 119 or 120 remains in a steady pressure state.

Pumps 104, 105 and 106 are mounted for fluid communication with a reservoir 121.

Figure 13:
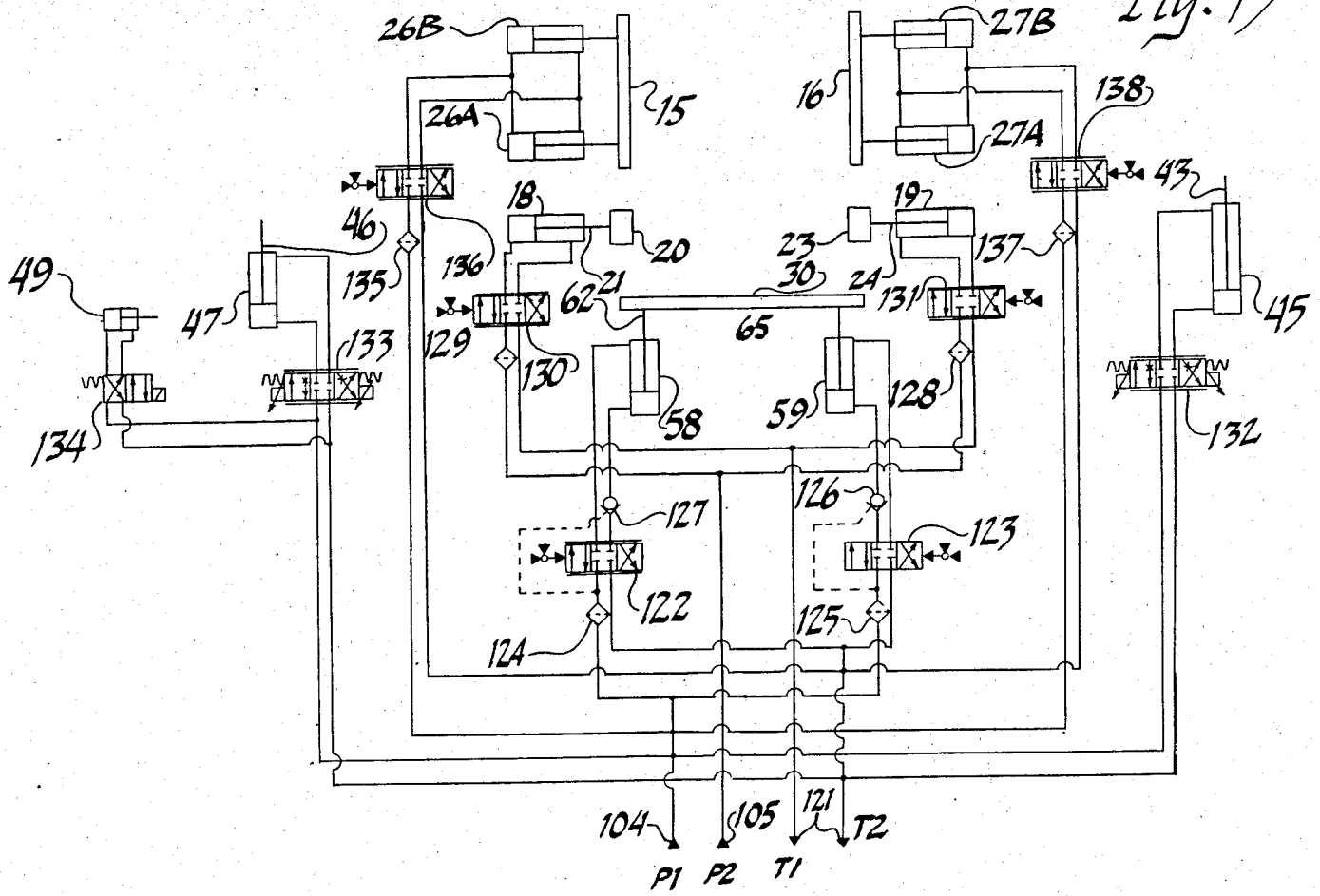

Referring now to FIG. 13, the hydraulic circuit for bulldozer lock cylinder 49, bulldozer cylinders 45 and 47, left-hand and right-hand arms 15 and 16, die table 30 and tension cylinders 18 and 19 is shown and explained. Die table servo valves 122 and 123 operate under control of electronics to properly position die table 30 either in a symmetrical or a tilted, asymmetrical position, as desired.

High pressure servo valve filters 124 and 125 protect servo valves 122 and 123 from contamination. Pilot operated check valves 126 and 127 insure that the die table cylinders 58 and 59 remain in place if servo valves 122 or 123 fail or if power to the machine fails. Check valves 126 and 127 permit unimpeded flow toward die table cylinders 58 and 59 but require pressure to be present in the circuit to keep them open when flow is in the opposite direction.

Servo valve filters 128 and 129 protect a pair of tension cylinder servo valves 130 and 131 from contamination. Tension cylinder servo valves 130 and 131 operate under control of electronics to provide position control. During a manual forming mode, tension cylinders 18 and 19 operate under pressure control rather than position control. In this mode, tension cylinder servo valves 130 and 131 act as solonoid directional valves responding to push-buttons.

Proportional current selector valves 132 and 133 act like servo valves through the electronics to direct action of the bulldozer clamp cylinders 45 and 47 which, during the forming process, must move in concert.

A solonoid operated selector valve 134 operates the retractable lock pin cylinder 49.

Servo valve filters 135 and 137 protect servo valves 136 and 138 which control the arm actuating cylinders 26 and 27.

Figure 14:
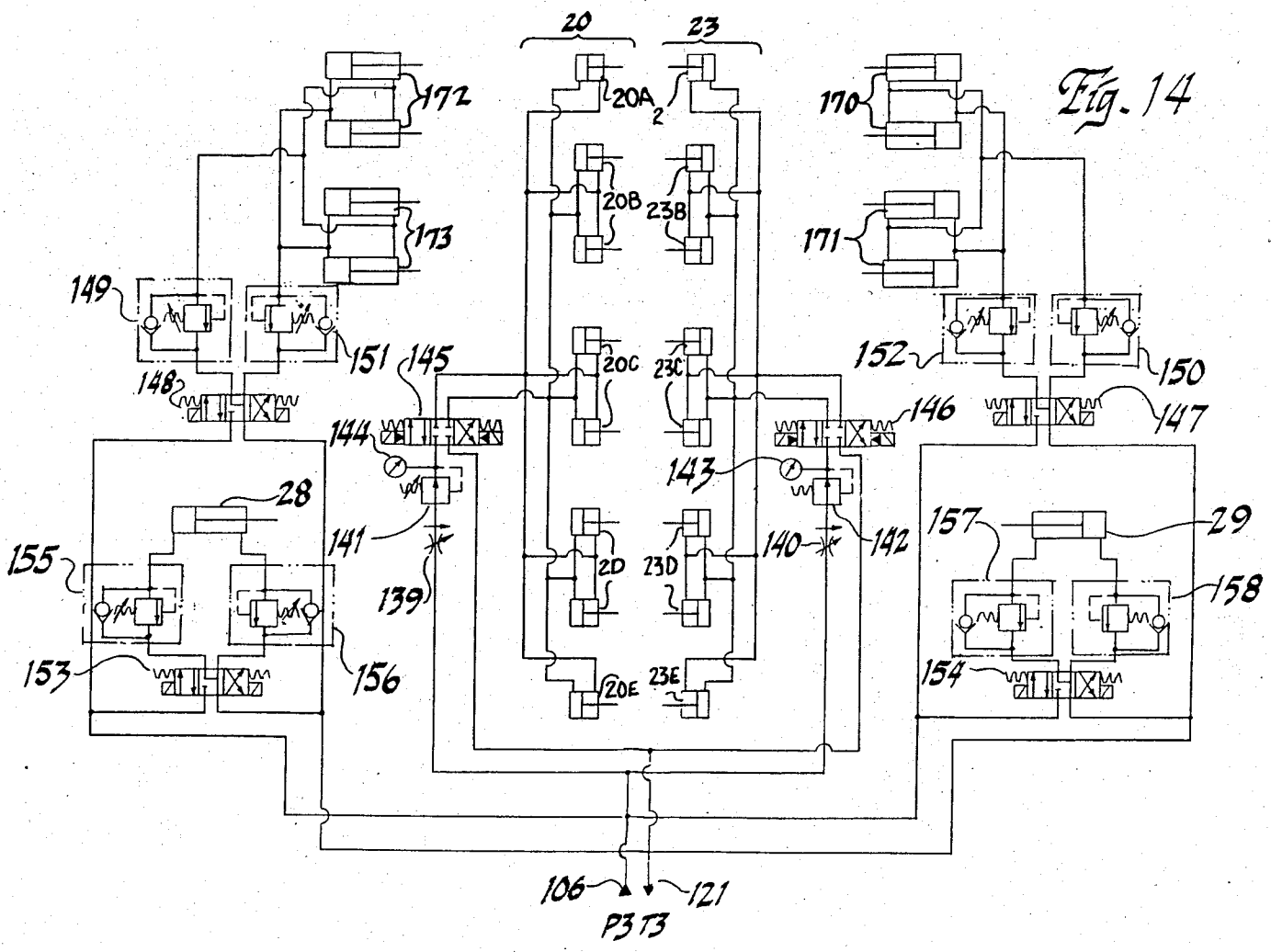

Referring now to FIG. 14, each arm is operated individually both as to the rate of movement and the limits of movement. Two pairs of cylinders 26A, 26B and 27A, 27B, tied together hydraulically and mechanically, operate one of the arms 15 and 16, respectively. Fixed flow control valves 139 and 140 evenly divide hydraulic fluid flow to each of the jaws 20 and 23 so that both can be opened or closed simultaneously. Adjustable pressure reducing valves 140 and 142 allow the grip pressure of jaws 20 and 23 to be varied to accommodate different gauges and hardnesses of metal sheets being formed.

Pressure gauges 143 and 144 permit observation of pressure in pressure reducing valves 140 and 142, respectively.

Solonoid operated selector valves 145 and 146 control the opening and closing of jaws 20 and 23, respectively.

As mentioned above, the jaws 20 and 23 each have five power curvable segments 20A–20E and 23A–23E. Jaws 20 and 23 are capable of attaining both concave and convex positions. Solonoid operated selector valves 147 and 148 control one set of curving cylinders 170, 171 and 172, 173, respectively. Selector valves 147 and 148 are equipped with a central spool position allowing individual jaw segments to "float", meaning that individual jaw segments remain in a set position unless pulled in excess of a particular pressure by the sheet. Counterbalance valves 149, 150, 151 and 152 have a free flow check in one direction of fluid flow and are set to counterbalance the weight of the individual jaw segments. Therefore, the jaws can be curved to a position and held in that position.

Solonoid operated selector valves 153 and 154 control the left-hand and right-hand swing cylinders 28, 29, respectively.

Counterbalance valves 155, 156, 157 and 158 add a counterweight pressure to overcome a counter-pressure tendency to rotate arms 15 and 16 downwardly.

The stretch former 10 and 10' disclosed above is designed to form metal sheets much more quickly and inexpensively than could be done on a conventional drop hammer machine. Furthermore, the combination of a lifting die table 30 cooperating with the downwardly moving arms 15 and 16 enables the machine to be constructed in a much more compact, less costly manner, and also increases operator safety and comfort by keeping the metal sheet being formed in a central position where it can be easily manipulated by the machine operator. The comfort and safety of the operator is further enhanced by the construction of the bulldozer platen 33 in FIG. 1 and the bulldozer beam 40 in FIG. 2. In both embodiments, free access to the metal sheet is permitted for loading and unloading while nevertheless facilitating the fabrication of formed metal sheets which can only be formed through the cooperation of male and female dies.

A stretch forming apparatus and method is disclosed above. The description of the stretch forming apparatus and method are provided for the purpose of illustration only and not for the purpose of limitation, the invention being defined by the claims.

I claim:

1. A method of stretch forming a metal sheet comprising the steps of:

(a) tensioning a metal sheet to be formed into its yield range unidimensionally in the direction from one of its margins to its opposite margin;

(b) moving the opposite margins of said metal sheet outwardly and downwardly to draw the sheet over a male draw-forming die positioned under said sheet while maintaining the metal sheet in a tensioned state within its yield range;

(c) reciprocating a complementary female down-acting die mounted above said male die downwardly into close proximity with said male die while the metal sheet is wrapped in a tension state therebetween and imparting a predetermined shape to the metal sheet;

(d) moving said male die vertically upwardly in the direction opposite the downward movement of the margins of said metal sheet;

(e) moving said female down-acting die upwardly out of proximity with said male die; and (f) relieving the tension on said metal sheet.

2. A method according to claim 1, and including the steps of mounting the female down-acting die on a bulldozer beam, supporting the bulldozer beam on opposite sides thereof transversed to the tensioning direction of the metal sheet for reciprocating up and down movement in sheet forming cooperation with the metal die, removing the support of the bulldozer beam on one side thereof only between sheet forming operations whereby the beam is supported only on the other side for facilitating the removal of the sheet from the one side and the placement of an unformed sheet in the jaws from the same one side.

* * * * *